US009787028B2

(12) United States Patent
Enriquez-Shibayama et al.

(10) Patent No.: US 9,787,028 B2
(45) Date of Patent: Oct. 10, 2017

(54) IMPROVING SIGNALING PERFORMANCE IN CONNECTOR DESIGN

(75) Inventors: Raul Enriquez-Shibayama, Jalisco (MX); Kai Xiao, University Place, WA (US); Xiang Li, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 33 days.

(21) Appl. No.: 13/997,893

(22) PCT Filed: Mar. 31, 2012

(86) PCT No.: PCT/US2012/031758

§ 371 (c)(1),
(2), (4) Date: Jun. 25, 2013

(87) PCT Pub. No.: WO2013/147912

PCT Pub. Date: Oct. 3, 2013

(65) Prior Publication Data

US 2014/0162498 A1 Jun. 12, 2014

(51) Int. Cl.

*H01R 13/6461* (2011.01)
*H01R 12/73* (2011.01)
*H01R 13/6471* (2011.01)

(52) U.S. Cl.

CPC ..... *H01R 13/6461* (2013.01); *H01R 12/737* (2013.01); *H01R 13/6471* (2013.01); *H01R 2201/06* (2013.01)

(58) Field of Classification Search

CPC ..... H01R 13/6471; H01R 13/6587; H01R 13/6461; H01R 12/716; H01R 13/6658
See application file for complete search history.

(56) References Cited

U.S. PATENT DOCUMENTS 5,024,609 A * 6/1991 Piorunneck ..... H01R 12/721 439/60
5,580,257 A * 12/1996 Harwath ..... 439/108
5,634,819 A * 6/1997 Pan ..... H01R 12/721 439/637
5,820,392 A 10/1998 Lin et al.
5,876,214 A 3/1999 McHugh et al.
7,232,344 B1 * 6/2007 Gillespie ..... H01R 12/721 439/634
8,366,464 B1 * 2/2013 Figuerado ..... G06F 1/185 439/160
8,657,631 B2 * 2/2014 Lang ..... H01R 13/65802 439/607.08

(Continued)

FOREIGN PATENT DOCUMENTS

WO 2013/147912 A1 10/2013

OTHER PUBLICATIONS

International Preliminary Report on Patentability received for PCT Patent Application No. PCT/US2012/031758, mailed on Oct. 9, 2014, 6 pages.

(Continued)

*Primary Examiner* — Truc Nguyen
(74) *Attorney, Agent, or Firm* — Jordan IP Law, LLC

(57) ABSTRACT

Apparatus and methods of arranging ground pins and signal pins in a card connector includes arranging a signal pins and ground pins in a card connector into at least six (6) columns divided between a primary side and a secondary side of the connector.

23 Claims, 9 Drawing Sheets

(56) References Cited

U.S. PATENT DOCUMENTS

| | | | | |
|---|---|---|---|---|
| 8,784,116 | B2 * | 7/2014 | Buck | H01R 12/585 439/55 |
| 2004/0121655 | A1 | 6/2004 | Ling et al. | |
| 2007/0099455 | A1 * | 5/2007 | Rothermel | H01R 12/585 439/108 |
| 2007/0123109 | A1 * | 5/2007 | Gillespie | H01R 12/721 439/634 |
| 2007/0128896 | A1 * | 6/2007 | Willis | H05K 1/116 439/79 |
| 2007/0152768 | A1 | 7/2007 | Mellitz et al. | |
| 2008/0066951 | A1 * | 3/2008 | Goergen | H05K 1/0218 174/255 |
| 2010/0048043 | A1 * | 2/2010 | Morlion | H05K 1/114 439/78 |
| 2010/0167557 | A1 * | 7/2010 | Hoang | H05K 1/117 439/62 |
| 2011/0201234 | A1 * | 8/2011 | Long | H01R 13/6585 439/630 |
| 2011/0275249 | A1 * | 11/2011 | Cartier | H01R 13/6474 439/660 |
| 2012/0034820 | A1 * | 2/2012 | Lang | H01R 13/65802 439/660 |
| 2012/0252232 | A1 * | 10/2012 | Buck | H01R 12/585 439/55 |

OTHER PUBLICATIONS

International Search Report and Written Opinion received for PCT application No. PCT/US2012/031758, mailed on Nov. 16, 2012, 9 pages.

"Connector PF version, 0.76 um Gold plating, FCI Connector PF version, 0.76 um Gold plating", http://portal.fciconnect.com/Comergent/en/US/adirect/fci?cmd=DownloadD . . . , Oct. 7, 2008, pp. 1-2.

"MicroTCA™ Card Edge Connectors", FCI MicroTCA™ Card Edge Connectors, 2 pages.

"PF Type Connector", FCI PF Type Connector MicroTCA, Jul. 15, 2008, 4 pages.

Franco, "Introduction to MicroTCA", PICMG MicroTCA, pp. 1-15.

Wu, "MicroTCA™ Press-Fit Connector", Product Specification MicroTCA™ Press-Fit Connector, No. GS-12-422, Mar. 1, 2007, pp. 1-11.

* cited by examiner

IMPROVING SIGNALING PERFORMANCE IN CONNECTOR DESIGN

BACKGROUND

Card edge connectors are widely used on computer platforms. Some examples of card edge connectors include Peripheral Component Interconnect Express (PCIe) connectors and other riser connectors. Typically, a card edge connector has two sides a primary side and a secondary side. There are pins on both sides of the card edge connectors to enable making contact to gold fingers on the corresponding side of a riser card when the riser card is inserted into the card edge connector.

BRIEF DESCRIPTION OF THE DRAWINGS

The various advantages of the embodiments of the present invention will become apparent to one skilled in the art by reading the following specification and appended claims, and by referencing the following drawings, in which:

DETAILED DESCRIPTION

Embodiments may involve a method of enabling more flexible pin assignment and better electrical performance in a card connector. The method may include assigning at least six columns of signal pins and ground pins in a foot print of the card connector. The at least six columns of signal pins and grounds pins may be associated with a primary side and a secondary side of the connector.

Embodiments may involve a card connector configured to have at least a first group of two columns of signal pins, a second group of two columns of ground pins, and a third group of two columns of signal pins. A number of columns of signal pins and ground pins on a primary side of the card connector may be equal to a number of signal pins and grounds pins on a secondary side of the card connector.

Embodiments may involve a system configured to have a processor coupled with a system board. The system board is configured to accommodate modules via connectors. One or more of the connectors may be configured to have a foot print that includes at least six columns of signal pins and ground pins on its primary side and secondary side.

Figure 1:
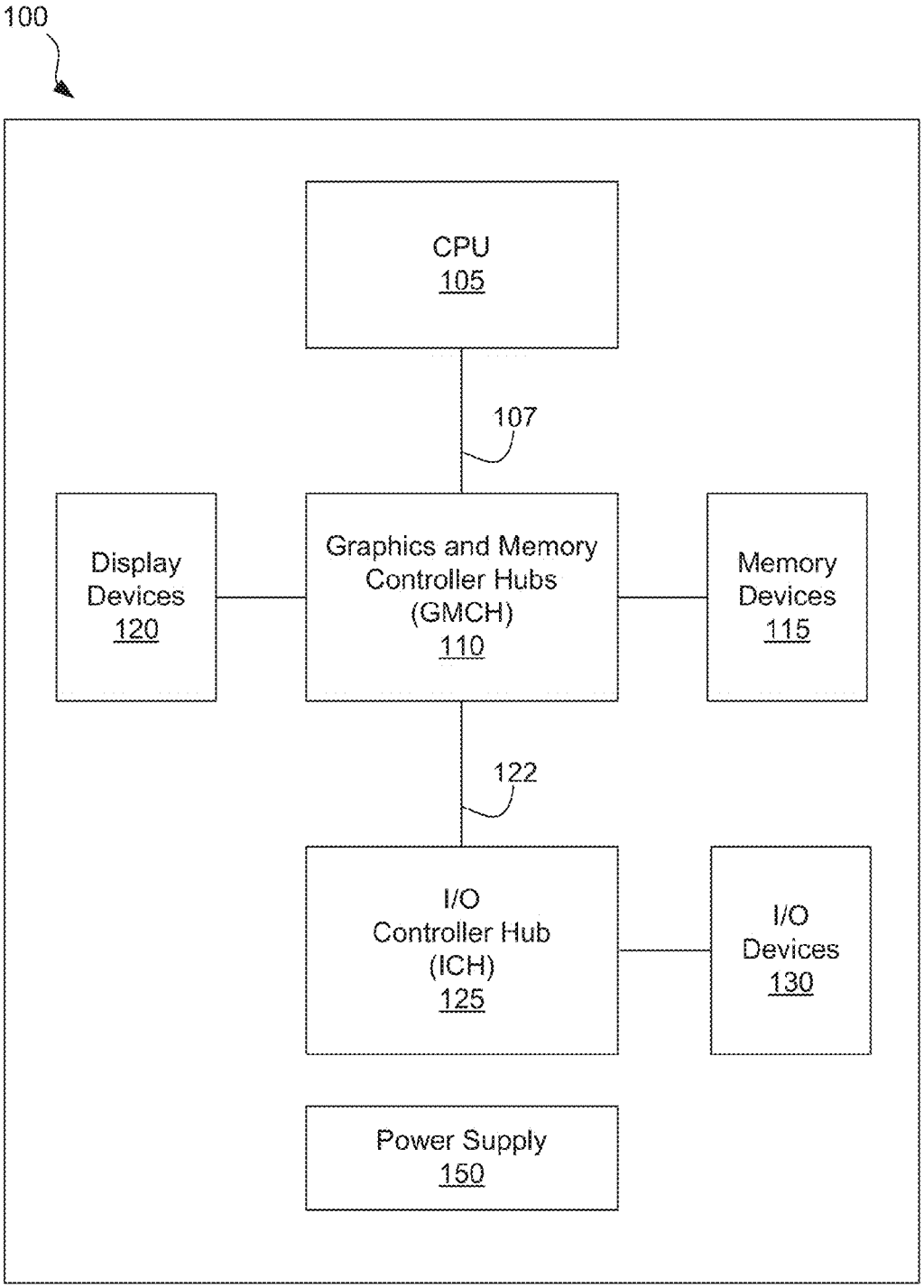
FIG. 1 is a block diagram that illustrates an example computer system, in accordance with some embodiments.

Turning to FIG. 1, a block diagram that illustrates an example computer system 100 is shown, in accordance with some embodiments. The computer system 100 may include a central processing unit (CPU) 105, a graphics and memory controller hub (GMCH) 110, and an input/output controller hub (ICH) 125. The GMCH 110 may be coupled to the CPU 105 via a bus 107. The ICH 125 may be coupled to the GMCH 110 via a bus 122. The GMCH 110 may also be coupled to memory devices 115 and display devices 120. The ICH 125 may be coupled to I/O devices 130. Although the CPU 105, the GMCH 110 and the ICH 125 may be illustrated as separate components, the functions of two or more of these components may be combined. A power supply 150 may be used to provide power to the computer system 100. The power supply 150 may be a battery or an external power source. The computer system 100 may also include many other components; however, for simplicity, they are not shown.

It may be noted that although the configurations and illustrations of the connectors described herein may refer to differential pair arrangement, they are used as examples and are not meant to be limiting to only differential pair arrangement.

Figure 2A:
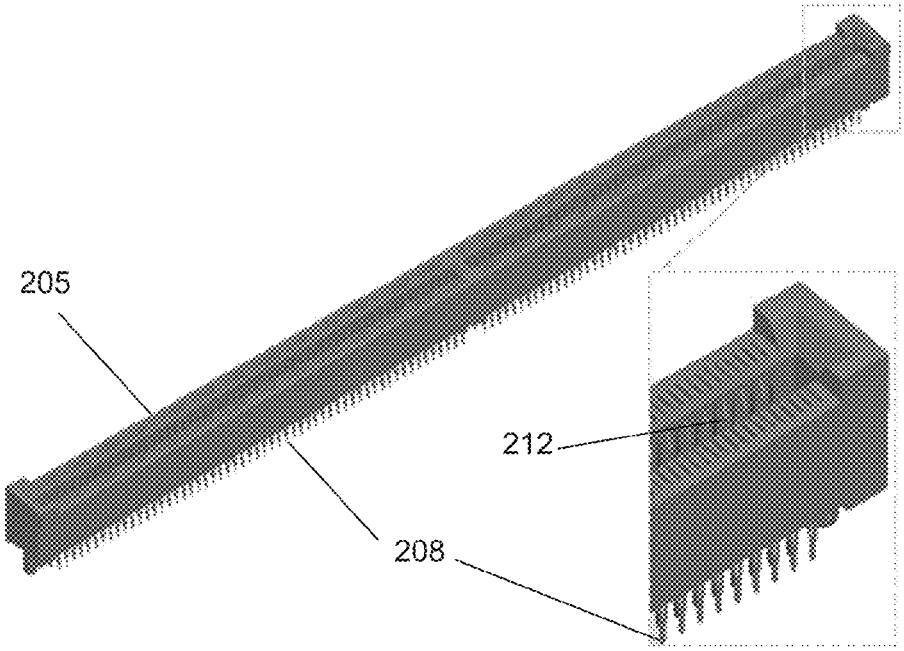
FIGS. 2A and 2B illustrate an example card edge connector, in accordance with some embodiments.
Figure 2B:
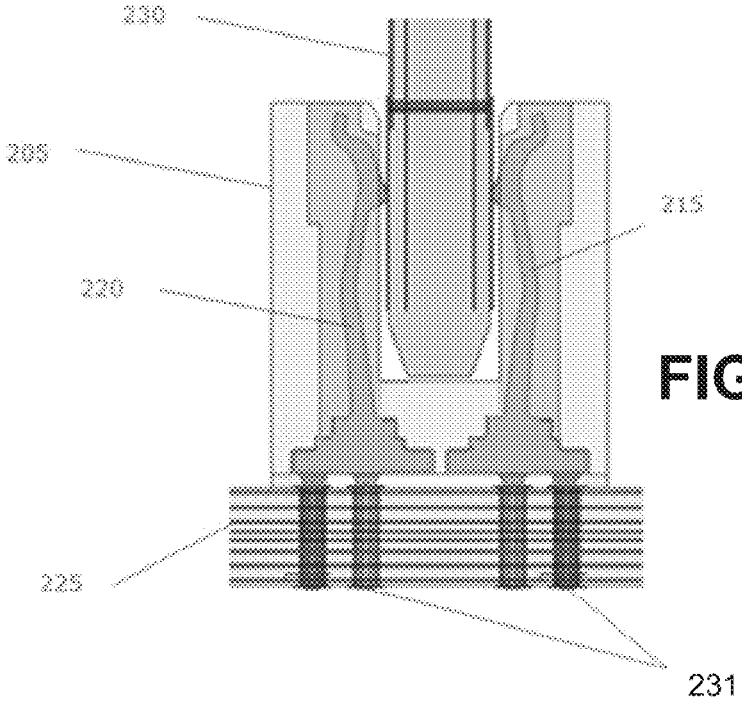

Turning to FIG. 2A, a diagram that illustrates an example card edge connector is shown, in accordance with some embodiments. The components of the computer system 100 may be associated with a system board or a riser board 225 (shown in FIG. 2B). The system board may include connectors that may be configured to accommodate the components. A connector 205 may include multiple contacts or pins 208, which may include ground pins and signal pins. The connector 205 may also include a slot 212 configured to receive an expansion card 230 (shown in FIG. 2B). For example, the expansion card may be a Peripheral Component Interconnect (PCI) card, a PCI Express (PCIE) card, an Accelerated Graphics Port (AGP) card, etc. FIG. 2B illustrates one example side view of the card edge connector 205, in accordance with some embodiments. The card edge connector 205 may include two sides 215 and 220 with both sides being associated with columns of pins 231.

Figure 3B:
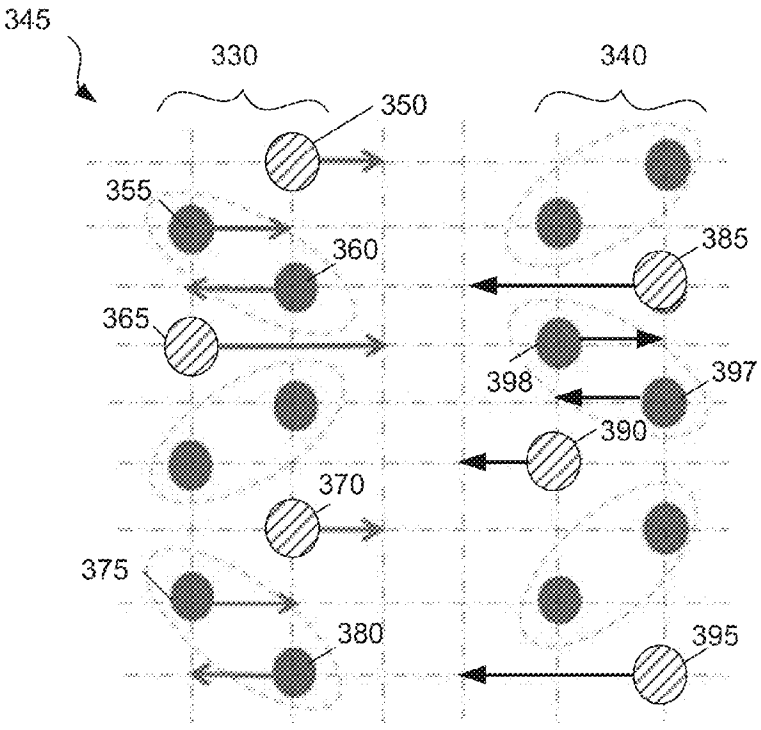
FIGS. 3A and 3B illustrate bottom views of an example card edge connector having four (4) columns of pins, in accordance with some embodiments.
Figure 3A:
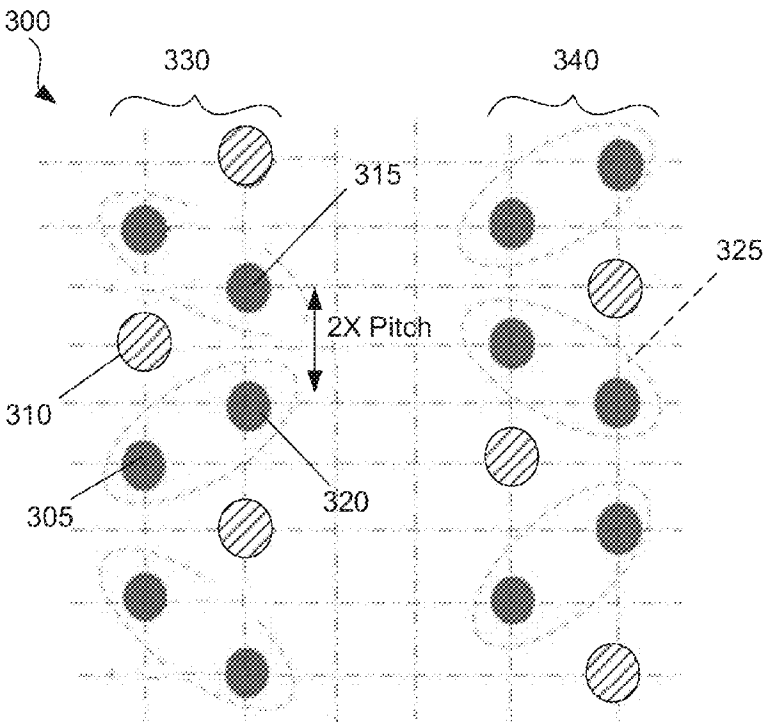

Turning to FIG. 3A, a diagram that illustrates example pin signals associated with a connector is shown, in accordance with some embodiments. In this example diagram 300, the pin assignment may be associated with assignment for differential signals on a card connector with a signal-to-ground ratio of 2:1. Dark shade circles 305 may represent signal pins. Hatched circles 310 array represent ground pins. The dotted oval 325 may represent a pair of adjacent signal pins (also referred to as differential pair grouping). As illustrated, there are four (4) columns of ground pins 310 and signal pins 305. The four (4) columns are shown in two groups 330 and 340. The group 330 may be associated with a primary side of the connector, and the group 340 may be associated with a secondary side of the connector. In this example, it may be noted that a shortest distance between the signal pins 315 and 320 in two adjacent differential pairs in the group 330 is two (2) pitches. The arrangement of the pins shown in FIG. 3A may result in undesirable crosstalk due to the close proximity of the signal pins. Typically, the crosstalk may be reduced by adding more ground pins and thus decreasing the signal pin to ground pin ratio (more ground pins as compared to signal pins). Adding more ground pins, however, may increase the size of the card edge connector if the pin pitch remains the same and may result in additional cost.

Turning to FIG. 3B, an example of reassigning the pins of a connector is shown, in accordance with some embodiments. In this example diagram 345, signal pins and ground pins may be reassigned to different positions to reduce cross talk and to provide better electrical performance. The reassignment of the pins may result in a different foot print. In this example, the ground pins 350, 365 and 370 and the signal pins 355 and 375 in the group 330 may be moved toward a central area of the connector, while the signal pins 360 and 380 may be moved way from the central area of the connector. The ground pins 385, 390 and 395 and the signal pin 397 in the group 340 may be moved toward the central area of the connector, while the signal pin 398 may be moved away from the central area of the connector. It should be noted that although the reassignment of the pins may result in the new foot print, the number of ground pins and signal pins in the connector may remain the same.

Figure 4:
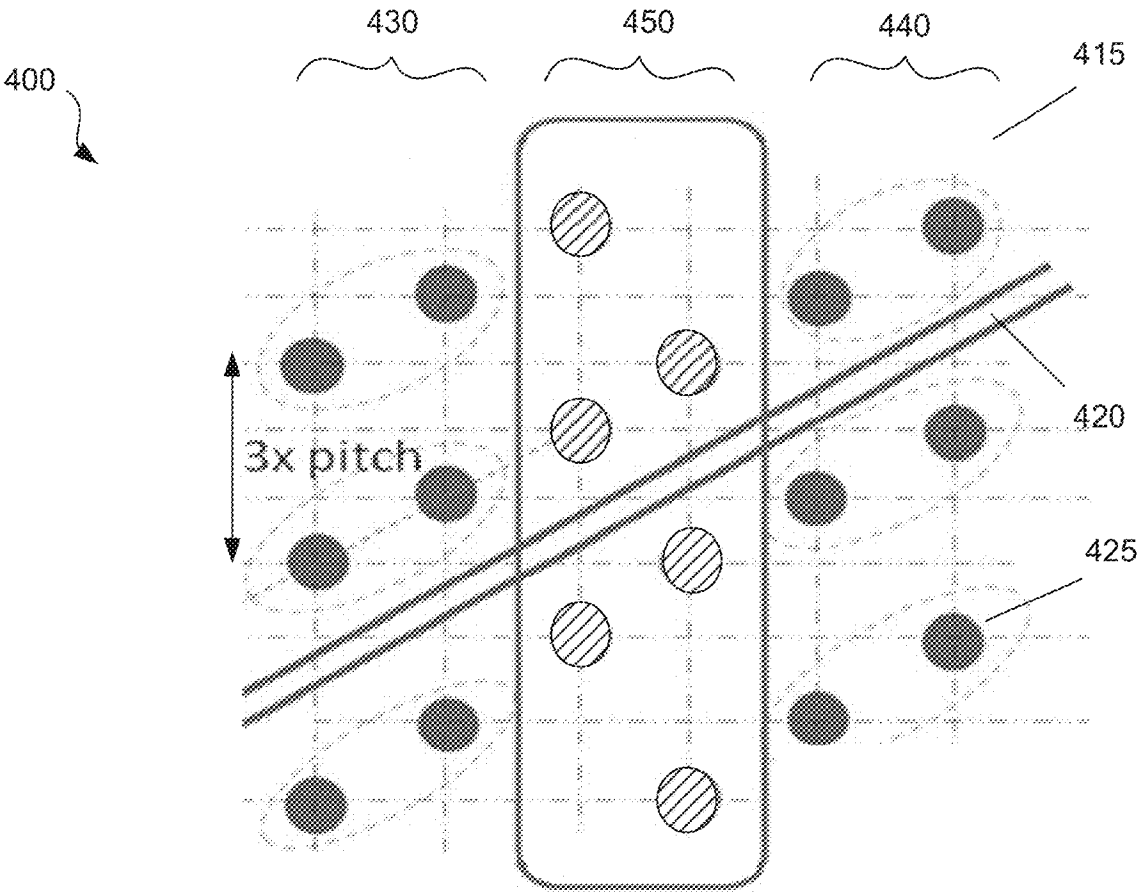
FIG. 4 illustrates an example card edge connector having six (6) columns of ground pins and signal pins, in accordance with some embodiments.

Turning to FIG. 4, a diagram that illustrates an example of an improved arrangement of pins is shown, accordance with some embodiments. Diagram 400 may represent an improved arrangement (or foot print) of pins of a connector illustrated in diagram 350 (shown in FIG. 3B). In this example, the pins are arranged in a left group 430, a right group 440, and a middle group 450 for a total of six (6) columns. Similarly to FIG. 3B, the dark shade circles may represent the signal pins, and the light shade circles may represent the ground pins. As mentioned, this example may correspond to a connector having differential signal arrangement. Each of the left group 430 and right group 440 may include two columns of six (6) signal pins. The middle group 450 may include two columns of ground pins.

It may be noted that there may be two types of crosstalk. There may be crosstalk associated with pins being on the same side (primary or secondary) of the connector. There may also be crosstalk associated with pins on opposite sides (primary vs. secondary) of the connector. With the differential pair arrangement, there may be crosstalk between pairs on the "same side" or pairs "cross-side".

In all six columns of the diagram 400, in the differential pin arrangement, the ground pins are no longer in the same column as the signal pins. In this example, a shortest distance between two signal pins of adjacent pairs of signal pins in the same group (430 or 440) is now three pitches instead of two (2) pitches. This increase in separation may help reducing the same-side crosstalk. Further, since the signal pins in the left group 430 and the right group 440 may be separated by the ground pins in the middle group 450, thus providing better shielding between the primary side and the secondary side, reducing the cross-side crosstalk. It may be noted that the number of signal pins and the number of ground pins shown in FIG. 4 is exactly the same as a number of signal pins and ground pins shown in FIG. 3A. As a result, the housing side may remain the same. Further, there should be no change to a riser board (the board with gold fingers) where the card edge connector may be mounted.

In addition, the arrangement shown in FIG. 4 provides for a wider and unblocking track 420, further reducing any potential crosstalk. Differential pair groupings (e.g., pair 425) may provide for better crosstalk performance. It should be noted the columns of ground pins and signal pins shown in FIGS. 3A, 3B and 4 may reflect the foot print of the connectors. As a result, the new position of the ground pins in group 450 of FIG. 4 may only affect the bottom of the connector where the connector is coupled with the PCB (printed circuit board).

Figure 5:
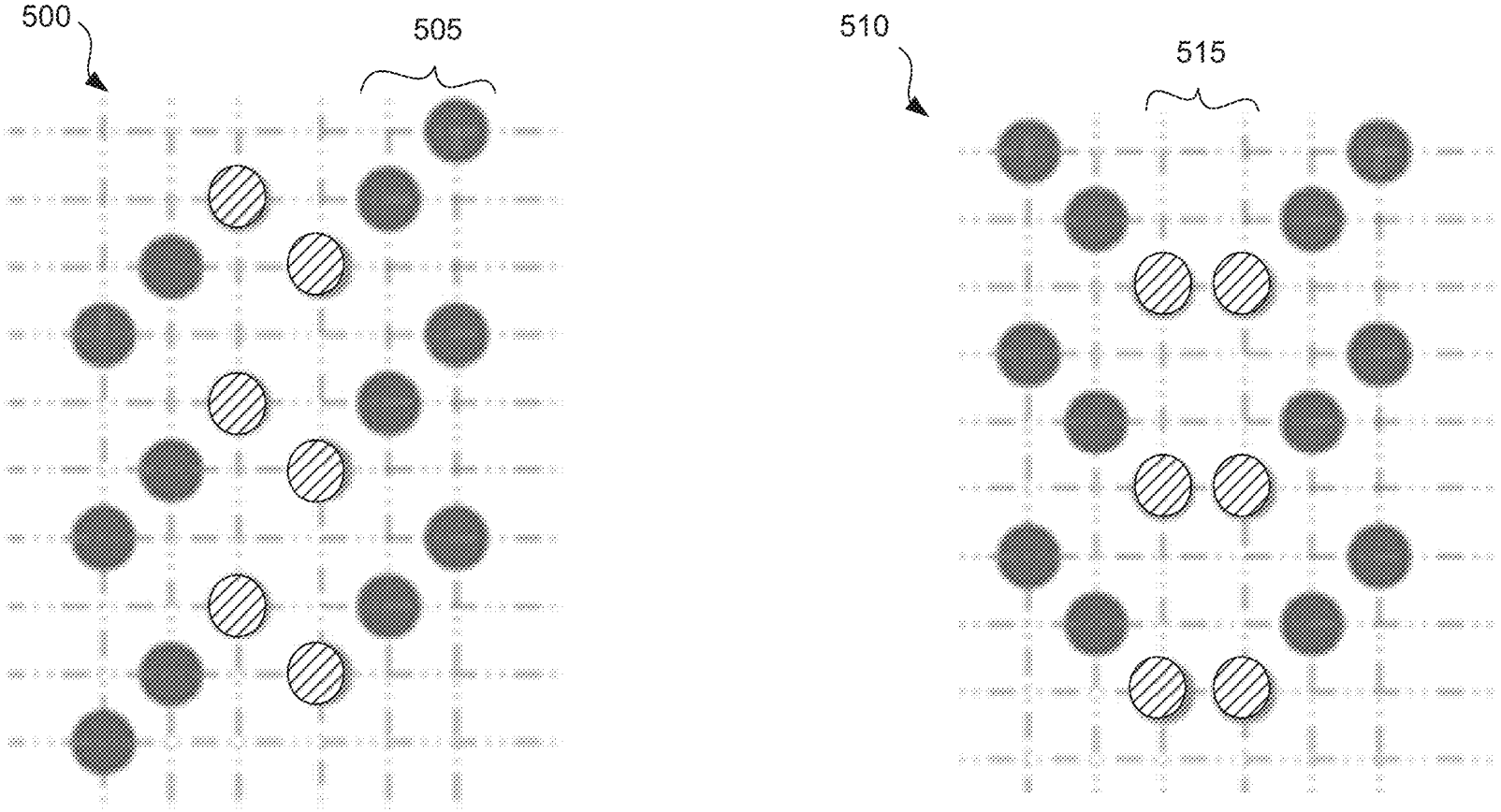
FIGS. 5 and 6 illustrates example variations of card edge connectors having six (6) columns of ground pins and signal pins, in accordance with some embodiments.

Turning to FIG. 5, two examples of an improved pin assignment are shown, in accordance with some embodiments. Diagram 500 shows a foot print of a connector where the pins may be arranged and an angle or diagonally but with the signal pins in the group 505 shifted. The angle arrangement may help reduce crosstalk especially between differential pairs. In comparison, when the pins directly face one another, the crosstalk may be more when the pitch is reduced.

Diagram 510 shows foot print of a connector where the pins may be arranged in a general "V" shape with the ground pins in the group 515 aligned. It may be noted that in both diagrams 500 and 510, the number of columns is six (6).

Figure 6:
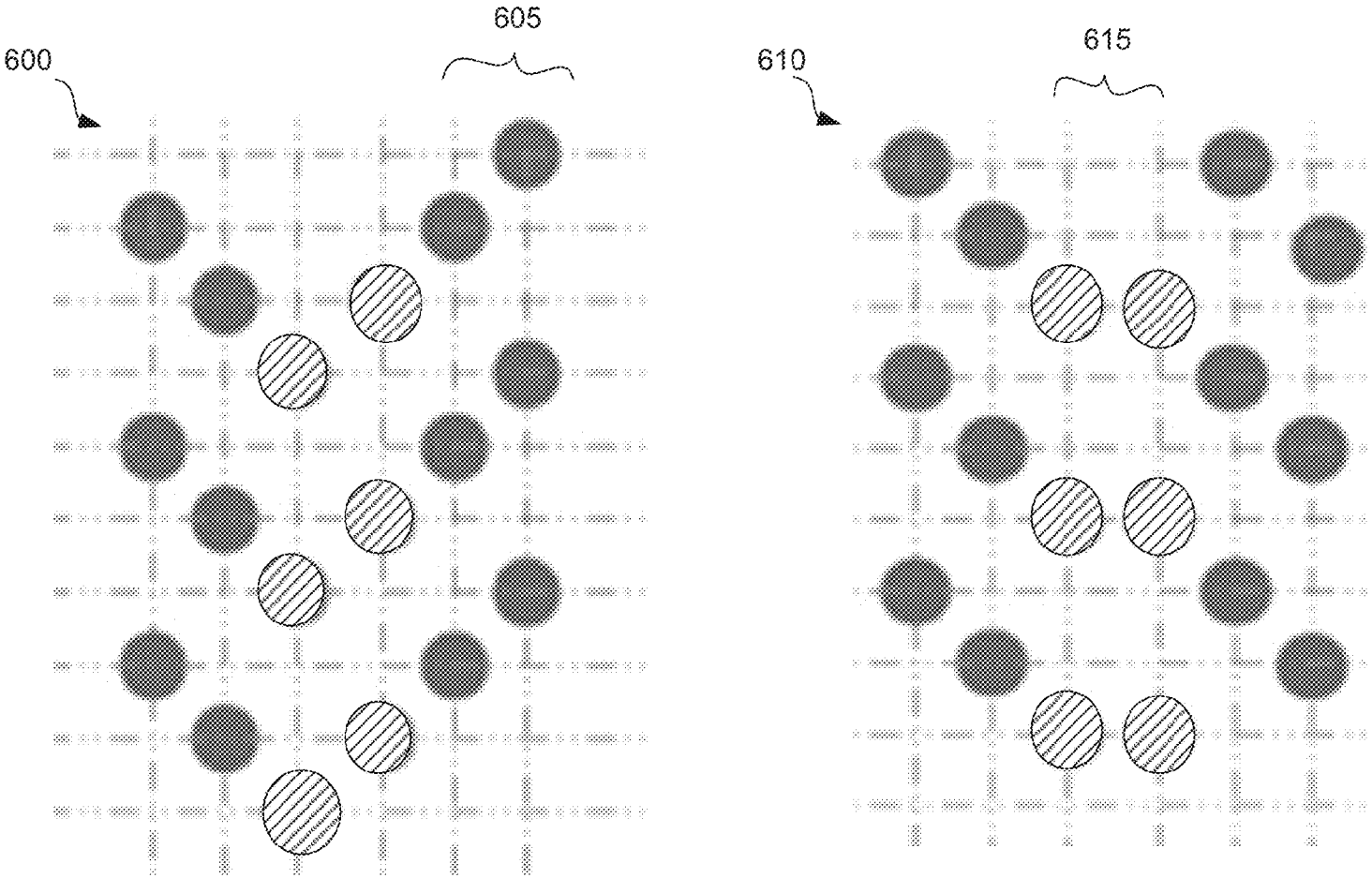

Turning to FIG. 6, two other examples of an improved pin assignment are shown, in accordance with some embodiments. Diagram 600 shows a foot print of a connector where the pins may be in a general "V" shape with the signal pins in the group 605 shifted. Diagram 610 shows a foot print of a connector where the pins may be arranged diagonally but with the ground pins in the group 615 aligned. It may be noted that in both diagrams 600 and 610, the number of columns is six (6).

Figure 7:
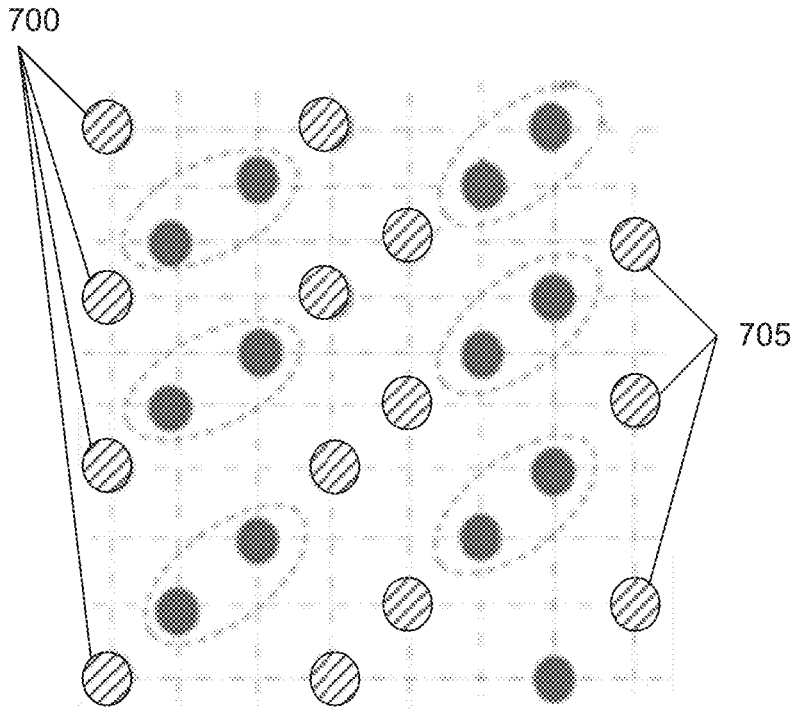
FIG. 7 illustrates an example variation of a card edge connector having eight (8) columns is shown, in accordance with some embodiments.

Turning to FIG. 7, a variation of the improved pin arrangements for a card edge connector having eight (8) columns is shown, in accordance with some embodiments. In this example, in addition to the six columns arrangement shown in FIG. 4, two additional columns of ground pins may be added. This is shown as ground pin column 700 on the far left side and ground pin column 705 on the far right side. The added ground pin columns 700 and 705 may help further reducing the same-side crosstalk. The added ground pin columns 700 and 705 may not require much change to the finger design of the card.

Figure 8:
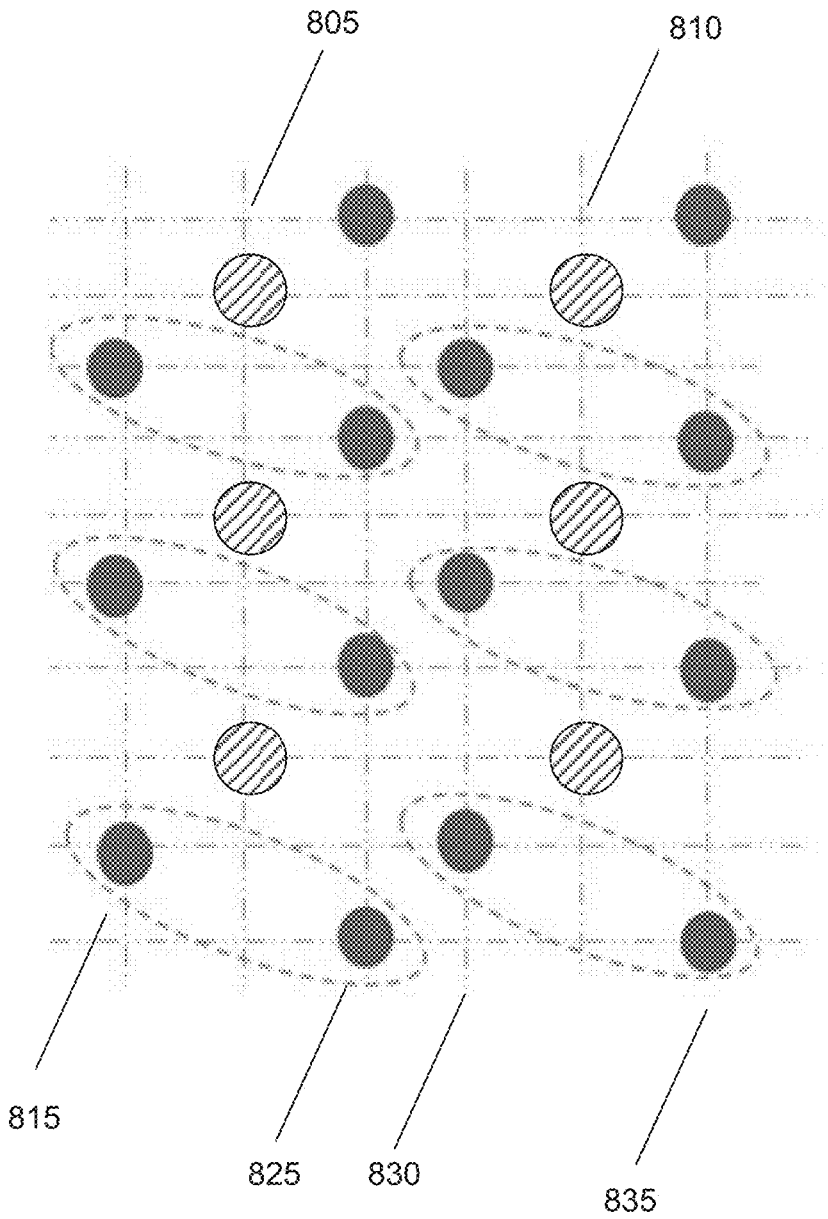
FIG. 8 illustrates an example variation of a card edge connector having a ground pin column in between signal pin columns is shown, in accordance with some embodiments.

Turning to FIG. 8, a variation of the improved pin arrangements for the card edge connector having a ground pin column in between signal pin columns is shown, in accordance with some embodiments. In this example, the total number of columns of signal and ground pins is still six (6); however, the ground pin column 805 is positioned between the signal pin columns 815 and 825. Similarly, the ground pin column 810 may be positioned in between the signal pin columns 830 and 835.

Figure 9:
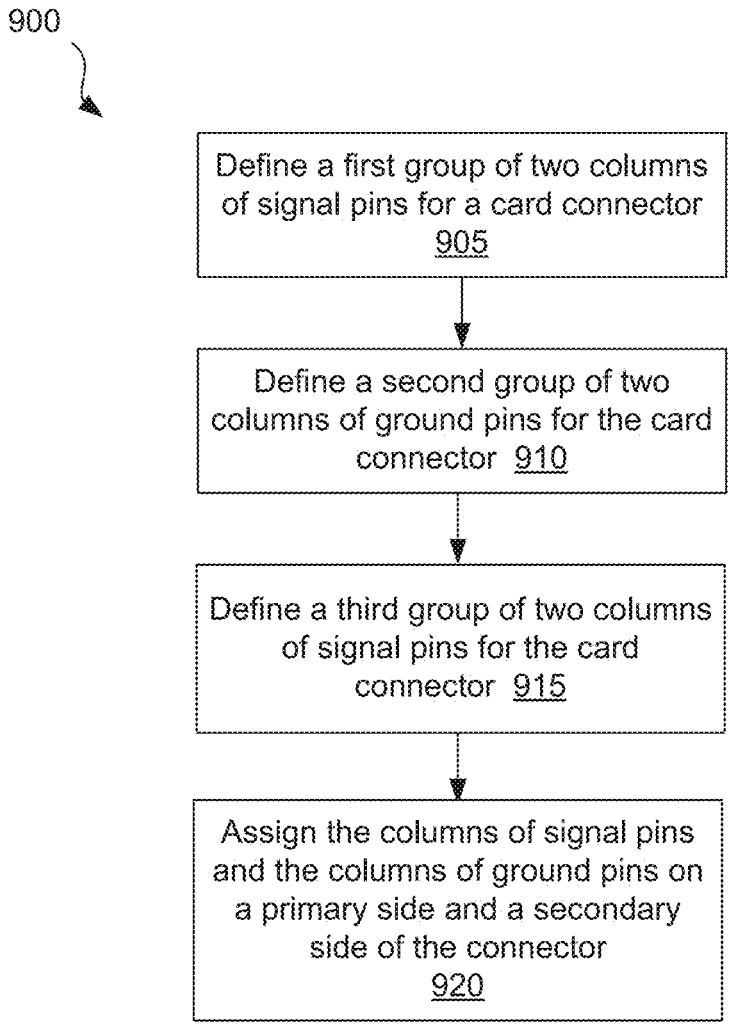
FIG. 9 illustrates an example flow diagram of a process of arranging ground and signal pins for a card edge connector having at least six (6) columns, in accordance with some embodiments.

Turning to FIG. 9, a method 900 of arranging ground and signal pins for a card edge connector to reduce crosstalk is shown. The process may start at block 905 where the signal pins associated with a first group of two columns may be defined. At block 910, the ground pins associated with a second group of two columns may be defined. At block 915, the signal pins associated with a third group of two columns may be defined. The signal pins associated with the first two columns and the third two columns and the ground pins associated with the second two columns may correspond to the examples shown in FIGS. 4-8. At block 920, the columns of signal pins and ground pins may be divided on the primary side and the secondary side of the connector. The division of the columns of ground pins and signal pins may be equally on both the primary and secondary side. Alternatively, the division may be unequal.

Example sizes/models/values/ranges may have been given, although embodiments of the present invention are not limited to the same. As manufacturing techniques (e.g., photolithography) mature over time, it is expected that devices of smaller size could be manufactured. In addition, well known power/ground connections to integrated circuit (IC) chips and other components may or may not be shown within the figures, for simplicity of illustration and discussion, and so as not to obscure certain aspects of the embodiments of the invention. Further, arrangements may be shown in block diagram form in order to avoid obscuring embodiments of the invention, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments of the invention, it should be apparent to one skilled in the art that embodiments of the invention can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. might be used herein only to facilitate discussion, and carry no particular temporal or chronological significance unless otherwise indicated.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

We claim:

1. A card connector comprising:

a primary side and a secondary side disposed on opposite sides of a single card receiving slot, wherein a number of columns of pins on each of the primary side and the secondary side is at least six, and wherein the pins include signal pins and ground pins that are equally disposed on both the primary side and the secondary side, and at least some of the signal pins are adjacently arranged into a plurality of groups, and wherein the number of columns of pins on both the primary side and the secondary side includes a first group of two columns of signal pins, a second group of two columns of ground pins, and a third group of two columns of signal pins.

2. The connector of claim 1, wherein the two columns of ground pins are positioned in between at least one column of signal pins in the first group and one column of signal pins in the third group.

3. The connector of claim 1, wherein the two columns of ground pins in the second group are adjacent to one another.

4. The connector of claim 1, wherein at least two signal pins in the first group of two columns of signal pins or in the second group of two columns of signal pins are configured as a differential pair.

5. The connector of claim 1, wherein a distance between two signal pins in the first group or in the third group is three pitches.

6. The connector of claim 1, further comprising:

a fourth group of two columns of ground pins, wherein the two columns of signal pins in the first group, the two columns of ground pins in the second group, and the two columns of signal pins in the third group are positioned in between a first column of ground pins of the fourth group and a second column of ground pins of the fourth group.

7. The connector of claim 1, wherein the signal pins in the first group or the signal pins in the third group are aligned at an angle with the ground pins in the second group.

8. The connector of claim 1, wherein a column of ground pins in the second group is positioned in between two columns of signal pins from the columns of signal pins in the first group and in the third group.

9. The connector of claim 1, wherein a ground pin in a first column of ground pins and a ground pin in a second column of ground pins are aligned horizontally.

10. The connector of claim 1, wherein a number of columns of pins on the primary side is equal to a number of columns of pins of the secondary side.

11. A computer-implemented method comprising:

assigning signal pins and ground pins of a card connector into at least six columns, wherein the at least six columns are assigned to each of a primary side and a secondary side of the card connector, and wherein the primary side and the secondary side are disposed on opposite sides of a single receiving card slot, and the at least six columns of signal pins and ground pins include at least two columns of ground pins and at least some of the signal pins are adjacently arranged into a plurality of groups, and wherein the number of columns of pins on both the primary side and the secondary side includes a first group of two columns of signal pins, a second group of two columns of ground pins, and a third group of two columns of signal pins.

12. The method of claim 11, wherein the two columns of ground pins are positioned adjacent to one another.

13. The method of claim 11, wherein the two columns of ground pins are separated by at least one column of signal pins.

14. The method of claim 11, wherein a ground pin in a first column of ground pins and a ground pin in a second column of ground pins are aligned horizontally.

15. The method of claim 11, wherein the at least six columns of signal pins and ground pins include four columns of signal pins.

16. The method of claim 15, wherein the at least six columns are divided equally between the primary side and the secondary side of the card connector.

17. A system comprising:

a processor; and a system board coupled to the processor and configured to accommodate a plurality of components via connectors, wherein one or more of the connectors includes at least six columns of signal pins and ground pins that are equally disposed on each of a primary side and a secondary side of the connector, wherein the primary side and the secondary side are disposed on opposite sides of a single card receiving slot, and at least some of the signal pins are adjacently arranged in a plurality of groups, wherein the connector is configured to include two additional columns of ground pins with one positioned on a far end of the primary side and another positioned on a far end of the secondary side.

18. The system of claim 17, wherein the connector is configured to include differential pairs in adjacent two columns of signal pins.

19. The system of claim 17, wherein the at least six columns of signal pins and grounds pins include two columns of ground pins positioned adjacent to one another.

20. The system of claim 17, wherein the at least six columns of signal pins and grounds pins include two columns of ground pins separated by at least one column of signal pins.

21. The system of claim 17, wherein the at least six columns of signal pins and grounds pins include two columns of ground pins, and wherein a ground pin in a first column of ground pins and a ground pin in a second column of ground pins are aligned horizontally.

22. The system of claim 17, wherein the at least six columns of signal pins and grounds pins include four columns of signal pins.

23. The system of any of the claim 17, wherein the at least six columns of signal and ground pins are divided equally between the primary side and the secondary side of the connector.

* * * * *